US009251944B2

(12) United States Patent
Hsieh et al.

(10) Patent No.: US 9,251,944 B2
(45) Date of Patent: Feb. 2, 2016

(54) VARIABLE COUPLED INDUCTOR

(71) Applicants: Lan-Chin Hsieh, Kaohsiung (TW); Cheng-Chang Lee, Yunlin County (TW); Chih-Hung Chang, Miaoli County (TW); Chih-Siang Chuang, Hsinchu (TW); Tsung-Chan Wu, Hsinchu County (TW); Roger Hsieh, Hsinchu County (TW)

(72) Inventors: Lan-Chin Hsieh, Kaohsiung (TW); Cheng-Chang Lee, Yunlin County (TW); Chih-Hung Chang, Miaoli County (TW); Chih-Siang Chuang, Hsinchu (TW); Tsung-Chan Wu, Hsinchu County (TW); Roger Hsieh, Hsinchu County (TW)

(73) Assignee: CYNTEC Co., LTD., Hsinchu (TW)

( * ) Notice: Subject to any disclaimer, the term of this patent is extended or adjusted under 35 U.S.C. 154(b) by 0 days.

(21) Appl. No.: 13/969,486

(22) Filed: Aug. 16, 2013

(65) Prior Publication Data

US 2014/0055226 A1 Feb. 27, 2014

(30) Foreign Application Priority Data

Aug. 21, 2012 (TW) ..... 101130231 A

(51) Int. Cl.

| | |
|---|---|
| ***H01F 17/06*** | (2006.01) |
| ***H01F 27/24*** | (2006.01) |
| ***H01F 17/04*** | (2006.01) |
| ***H01F 3/14*** | (2006.01) |
| ***H01F 38/02*** | (2006.01) |
| *H01F 3/10* | (2006.01) |

(52) U.S. Cl.

CPC ..... *H01F 17/04* (2013.01); *H01F 3/14* (2013.01); *H01F 38/023* (2013.01); *H01F 2003/106* (2013.01)

(58) Field of Classification Search

CPC ..... H01F 19/04; H01F 19/02; H01F 3/14; H01F 27/004; H01F 27/2847; H01F 37/00; H01F 29/00; H01F 21/02; H01F 17/04; H01F 38/023; H01F 2003/106; H01F 27/29

USPC ..... 336/178, 10, 87, 182, 212, 221, 220

See application file for complete search history.

(56) References Cited

U.S. PATENT DOCUMENTS

| | | | | |
|---|---|---|---|---|
| 4,728,918 | A * | 3/1988 | Neusser et al. | 336/83 |
| 5,440,225 | A * | 8/1995 | Kojima | 323/359 |
| 5,847,518 | A * | 12/1998 | Ishiwaki | 315/276 |
| 6,510,109 | B2 * | 1/2003 | Ohmori | 369/13.23 |
| 6,774,758 | B2 * | 8/2004 | Gokhale et al. | H01F 3/14 336/110 |
| 6,965,290 | B2 * | 11/2005 | Gokhale et al. | 336/178 |
| 7,772,955 | B1 * | 8/2010 | Li et al. | 336/200 |
| 2005/0151614 | A1 * | 7/2005 | Dadafshar | 336/223 |
| 2005/0258927 | A1 * | 11/2005 | Lu | 336/234 |
| 2008/0303624 | A1 * | 12/2008 | Yamada et al. | 336/212 |
| 2010/0085138 | A1 * | 4/2010 | Vail | 336/216 |

* cited by examiner

*Primary Examiner* — Mangtin Lian

(74) *Attorney, Agent, or Firm* — Min-Lee Teng; Litron Patent & Trademark Office

(57) ABSTRACT

A variable coupled inductor includes a first core, two conducting wires, a second core and a magnetic structure. The first core includes two first protruding portions, a second protruding portion and two grooves, wherein the second protruding portion is located between the two first protruding portions and each of the grooves is located between one of the first protruding portions and the second protruding portion. Each of the conducting wires is disposed in one of the grooves. The second core is disposed on the first core. A first gap is formed between each of the first protruding portions and the second core and a second gap is formed between the second protruding portion and the second core. The magnetic structure is disposed between the second protruding portion and the second core and distributed symmetrically with respect to a centerline of the second protruding portion.

17 Claims, 8 Drawing Sheets

VARIABLE COUPLED INDUCTOR

CROSS REFERENCE TO RELATED APPLICATIONS

This application claims the benefit of priority of Taiwan Application No. 101130231, filed Aug. 21, 2012, which is incorporated by reference herein in their entirety.

BACKGROUND OF THE INVENTION

I. Field of the Invention

The present invention relates to a variable coupled inductor and, in particular, to a variable coupled inductor can improve efficiency in both light-load and heavy-load situations.

II. Description of the Prior Art

A coupled inductor has been developed for a period of time; however, it is not often used in the circuit board. As a more powerful microprocessor needs a high current in a small circuit board, a variable coupled inductor has been gradually used in the circuit board. A variable coupled inductor can be used to reduce the total space of the circuit board consumed by traditional coupled inductors. Currently, a coupled inductor can reduce the ripple current apparently, wherein a smaller capacitor can be used to save the space of the circuit board. As the DC resistance (direct current resistance, DCR) of the coupled inductor is low, efficiency is better in a heavy-load situation. However, as the flux generated by each of the dual conducting wires will be cancelled each other when the dual conducting wires are coupled, the inductance becomes low and the efficiency becomes worse in a light-load situation.

SUMMARY OF THE INVENTION

One objective of present invention is to provide a variable coupled inductor that can increase the efficiency in both heavy-load and light-load situations to solve the above-mentioned problem.

In one embodiment, a variable coupled inductor is provided, wherein variable coupled inductor comprises a first core comprising a first protrusion, a second protrusion, a third protrusion, a first conducting-wire groove and a second conducting-wire groove, wherein the second protrusion is disposed between the first protrusion and the third protrusion, the first conducting-wire groove is located between the first protrusion and the second protrusion, and the second conducting-wire groove is located between the second protrusion and the third protrusion; a first conducting wire disposed in the first conducting-wire groove; a second conducting wire disposed in the second conducting-wire groove; a second core disposed over the first core, wherein a first gap is formed between the first protrusion and the second core, a second gap is formed between the second protrusion and the second core and a third gap is formed between the third protrusion and the second core; and a magnetic structure disposed between the second protrusion and the second core, wherein the magnetic structure is symmetric with respect to the central line of the second protrusion.

The present invention proposes that the magnetic structure is disposed between the second projection in the middle of the first core and the second core, wherein the magnetic structure is symmetric with respect to the central line CL of the second protrusion 102. Therefore, the initial-inductance of the variable coupled inductor can be enhanced and light-load efficiency can be improved by means of the magnetic structure.

In one embodiment, the material of the variable coupled inductor of the present invention can be a ferrite material to achieve a high-saturation current, and copper sheet is used as an electrode to reduce the DC resistance, so that the efficiency in heavy-load is improved.

BRIEF DESCRIPTION OF THE DRAWINGS

The foregoing aspects and many of the accompanying advantages of this invention will become more readily appreciated as the same becomes better understood by reference to the following detailed description when taken in conjunction with the accompanying drawings, wherein.

DETAILED DESCRIPTION OF THE INVENTION

Figure 1:
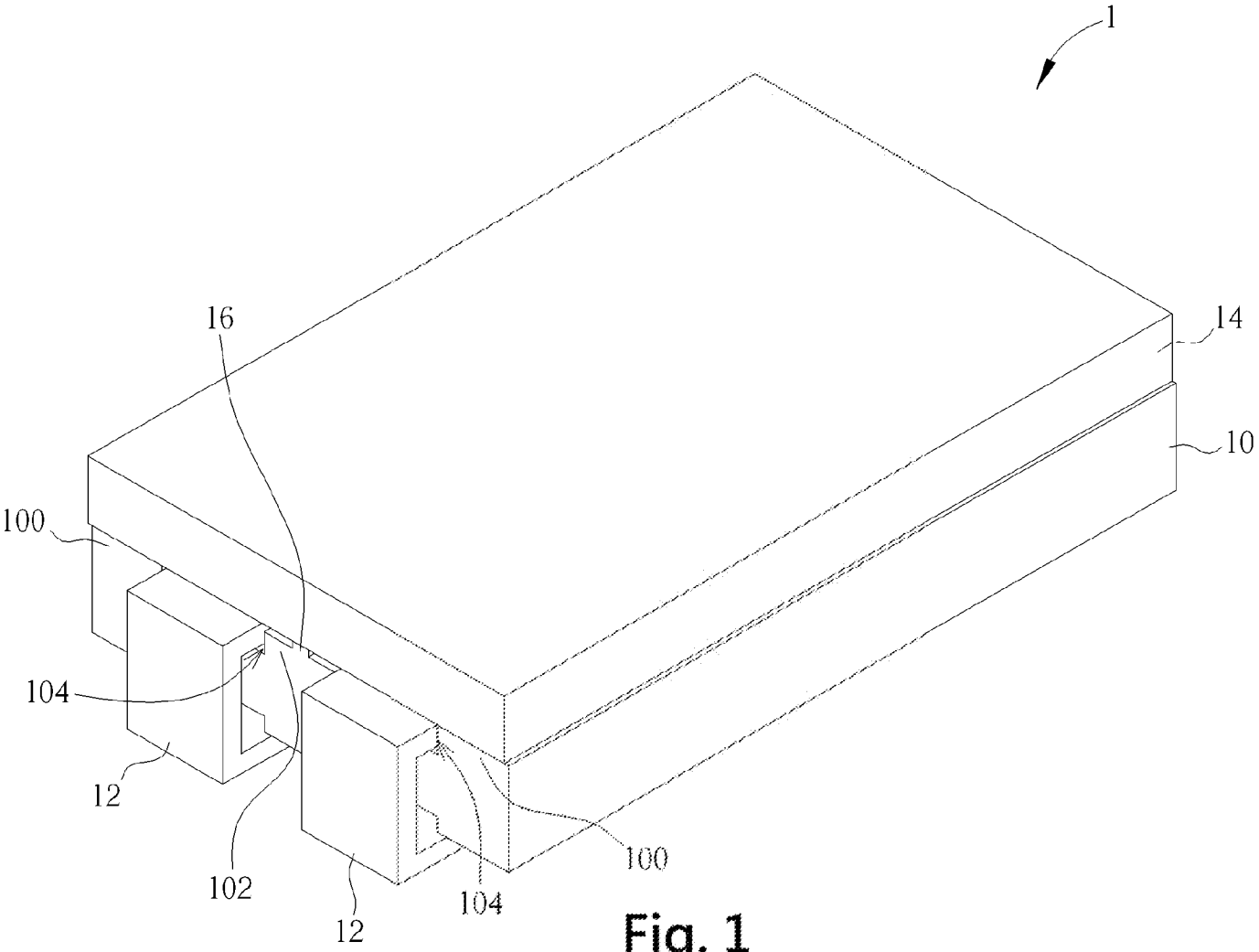
FIG. 1 illustrates a variable coupled inductor in three dimensions in accordance with one embodiment of present invention.
Figure 2:
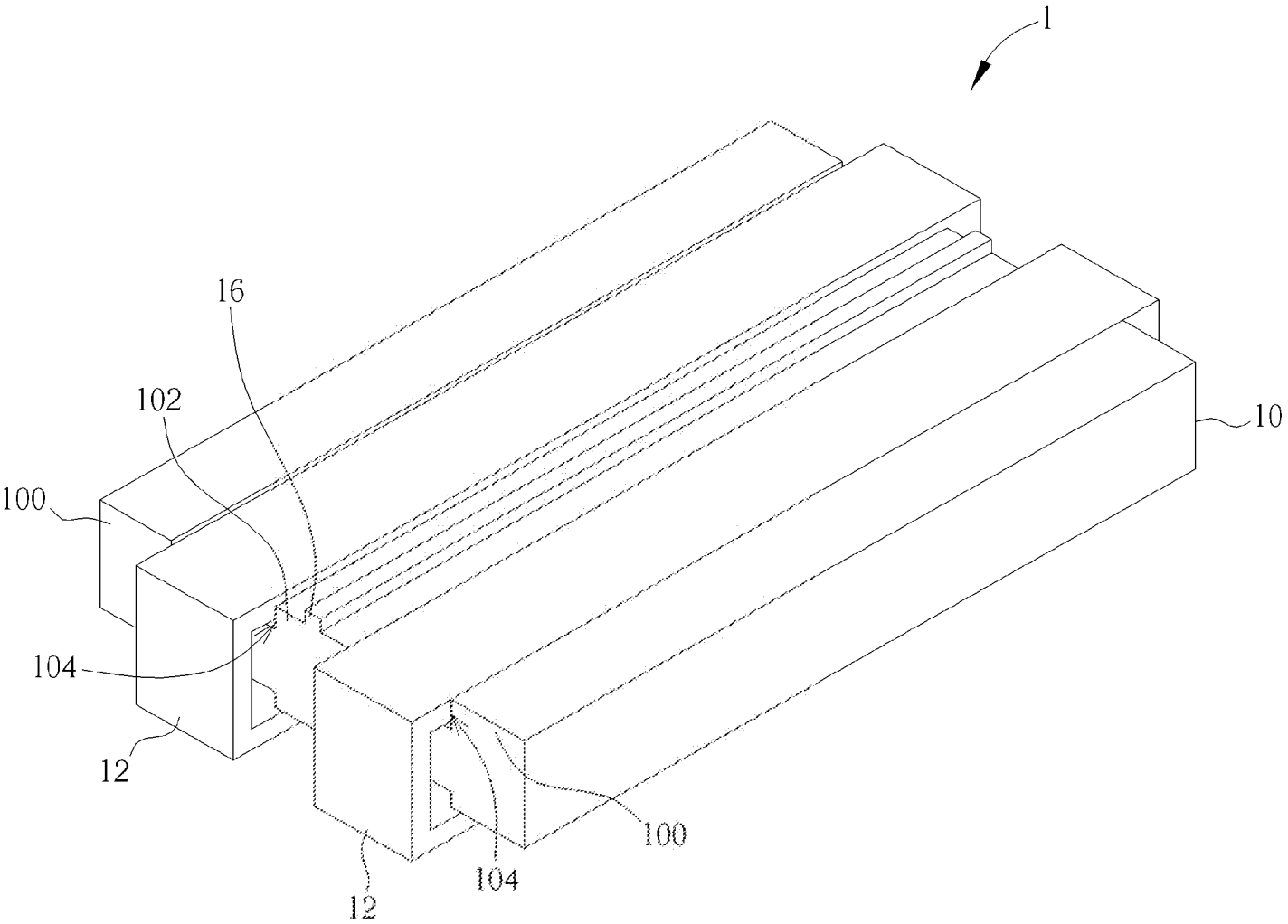
FIG. 2 illustrates the variable coupled inductor in FIG. 1 where the second core is removed.
Figure 3:
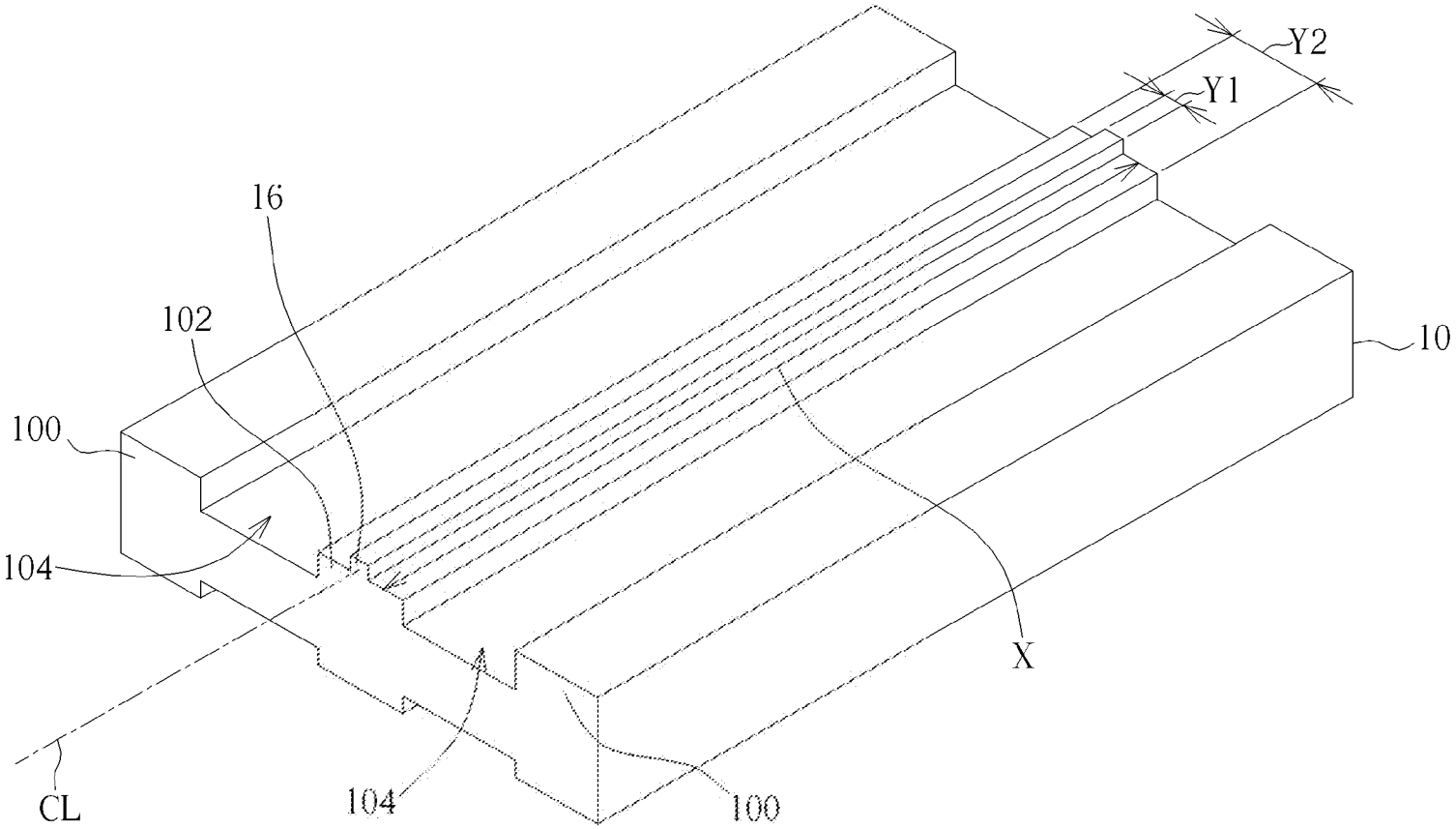
FIG. 3 illustrates the first core and the magnetic structure of the variable coupled inductor in FIG. 2.
Figure 4:
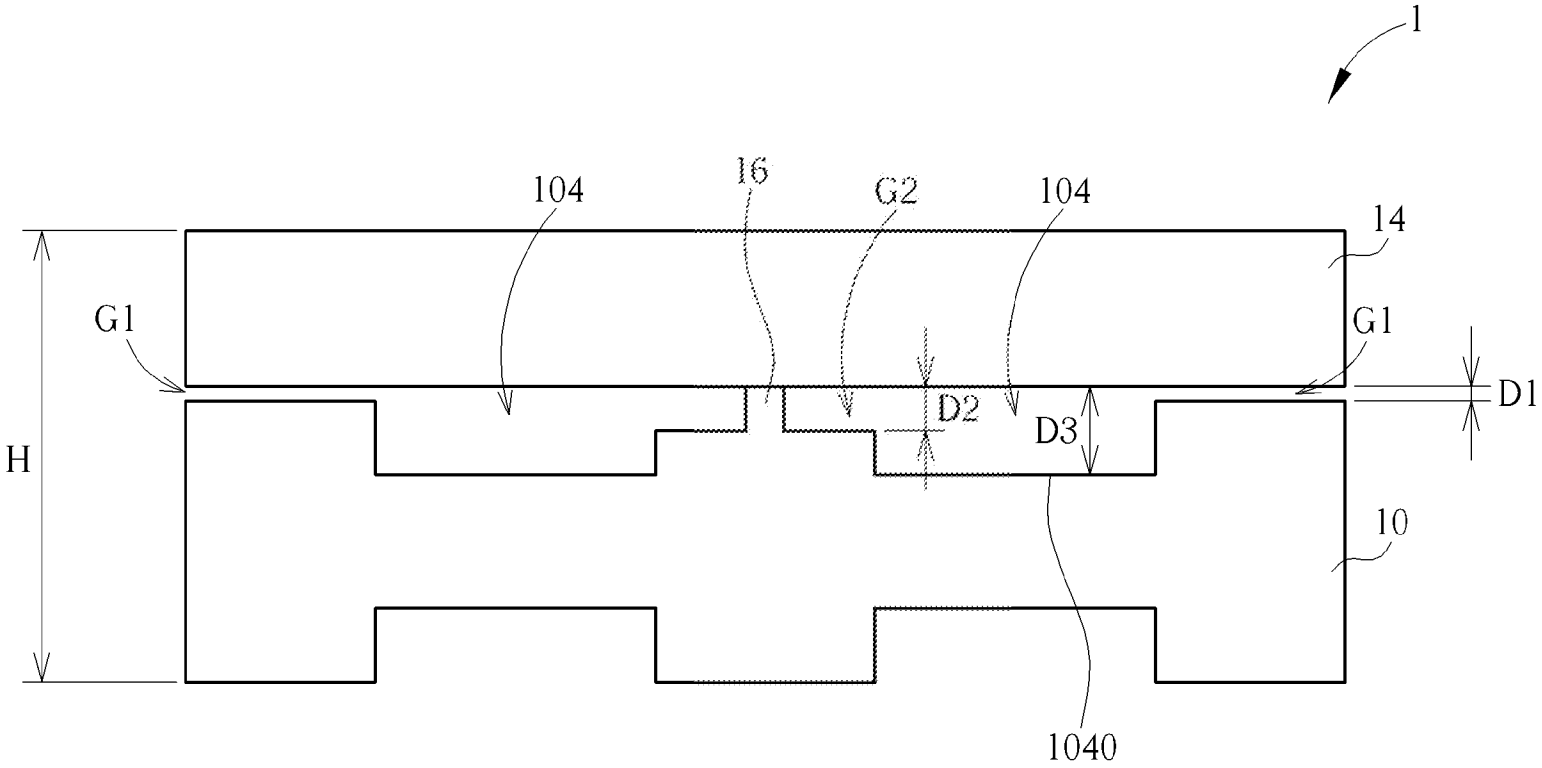
FIG. 4 illustrates a side view of the variable coupled inductor in FIG. 1 where the second conducting wire is removed.

Please refer to FIG. 1 to FIG. 4. FIG. 1 is a three dimensional view of a variable coupled inductor 1 according to one embodiment of the present invention. FIG. 2 is a three dimensional view of a variable coupled inductor 1 where the second core 14 is removed in FIG. 1. FIG. 3 is a three dimensional view of a first core 10 and a magnetic structure 16 in FIG. 2. FIG. 4 is a lateral view of a variable coupled inductor 1 wherein two conducting wires 12 are removed in FIG. 1. As illustrated in FIG. 1 to FIG. 4, the variable coupled inductor 1 comprises a first core 10, two conducting wires 12, a second core 14 and a magnetic structure 16. The first core 10 comprises two first protrusions 100, a second protrusion 102 and two conducting-wire grooves 104, wherein the second protrusion 102 is located between the two first protrusions 100, and each of the two conducting-wire groove 104 is located between corresponding one of the two first protrusions 100 and the second protrusion 102, respectively. In other words, the second protrusion 102 is located in the middle portion of the first core 10. Each of the two conducting wire 12 is disposed in one of the two conducting-wire grooves 104, respectively. The second core 14 is disposed over the first core 10 so that a first gap G1 is formed between each first protrusion 100 and the second core 14 and a second gap G2 is formed between the second protrusion 102 and the second core 14. A magnetic structure 16 is disposed between the second protrusion 102 and the second core 14, and the magnetic structure 16 is symmetric with respect to the central line CL of the second protrusion 102, as illustrated in FIG. 3 and FIG. 4.

As the second protrusion 102 is located in the middle portion of the first core 10 and the magnetic structure 16 is disposed between the second protrusion 102 and the second core 14, the magnetic structure 16 is located in the middle portion of the variable coupled inductor 1 after the variable coupled inductor 1 is fabricated. Furthermore, two ends of the magnetic structure 16 are respectively in full contact with the first core 10 and the second core 14. In this embodiment, magnetic structure 16 is, but not limit to, in a long-strip shape. In this embodiment, the material of the first core 10, the second core 14 and the magnetic structure 16 can be iron powder, ferrite, permanent magnet or other magnetic material. Because the first core 10 and the magnetic structure 16 are integrally formed, the material of the first core 10 is the same as that of the magnetic structure 16. In another embodiment, the magnetic structure 16 and the second core 14 are also formed integrally, in such case, the material of the second core 14 is the same as that of the magnetic structure 16. In another embodiment, the magnetic structure 16 can be also an independent device, in such case, the material of the magnetic structure 16 and the material of the first core 10, or the second core 14, can be the same or different. It should be noted that if the magnetic structure 16 is not in full contact with the first core 10 and the second core 14 due to manufacturing tolerance, magnetic glue can be filled in the gap (e.g., insulating resin and magnetic adhesive made of magnetic powder).

In this embodiment, the vertical distance D1 of the first gap G1 is smaller that the vertical distance D2 of the second gap G2. The first gap G1 can be an air gap, a magnetic gap and a non-magnetic gap, and the second gap G2 can be also an air gap, a magnetic gap and a non-magnetic gap. The first gap G1 and the second gap G2 can be designed according to the practical application. It should be noted that the air gap is a gap filled with air for isolating and it does not contain other material; because air has a larger magnetic reluctance, it can increase degree of saturation of the inductor. The magnetic gap is formed by filling the magnetic material in the gap to reduce the magnetic reluctance and to further increase the inductance; non-magnetic gap is formed by filling the non-magnetic material, except the air, in the gap to enhance the function that the air gap can not achieve, such as by filling a bonding glue to combine different magnetic materials. Preferably, the first gap G1 can be a non-magnetic gap, and the second gap G2 can be an air gap or a non-magnetic gap.

In this embodiment, the variable coupled inductor 1 has a total high H after the variable coupled inductor 1 is fabricated; the vertical distance D1 of the first gap G1 can be in a range between 0.0073H and 0.0492H and the vertical distance D2 of the second gap G2 can be in a range between 0.0196H and 0.1720H. Furthermore, as illustrated in FIG. 4, each of the first gap G1 and the second gap G2 lies within a height covered by the vertical distance D3 between the bottom surface of the conducting-wire groove 104 and the second core 14. In other words, when looking at the side view shown in FIG. 4, each top point of the first gap G1 and the second gap G2 is not higher than the top point of vertical distance D3 between the bottom surface of the conducting-wire groove 104 and the second core 14; and each bottom point of the first gap G1 and the second gap G2 is not lower than the bottom point of vertical distance D3 between the bottom surface of the conducting-wire groove 104 and the second core 14. In practical applications, the first gap G1 generates a major inductance and the second gap G2 generates a leakage inductance.

In this embodiment, the magnetic structure 16 has a first magnetic permeability $\mu 1$, the first gap G1 has a second magnetic permeability $\mu 2$, and the second gap G2 has a third magnetic permeability $\mu 3$, wherein the relationship between the first magnetic permeability $\mu 1$, the second magnetic permeability $\mu 2$ and the third magnetic permeability $\mu 3$ is $\mu 1 > \mu 2 \geq \mu 3$. In general, magnetic permeability is inversely proportional to the magnetic reluctance (i.e. the greater the magnetic permeability, the smaller the magnetic reluctance). The first magnetic permeability $\mu 1$ of the magnetic structure 16 is larger than each of the second magnetic permeability $\mu 2$ of the first gap G1 and the third magnetic permeability $\mu 3$ of the second gap G2, wherein the first gap G1 and the second gap G2 are located in two sides of the magnetic structure 16, respectively. In other words, the magnetic reluctance of the magnetic structure 16 is smaller than that of the first gap G1; and the magnetic reluctance of the magnetic structure 16 is smaller than that of the second gap G2.

For example, the magnetic structure 16 can be manufactured by LTCC (low temperature co-fired ceramic, LTCC) printing; in such case, the first magnetic permeability $\mu 1$ of the magnetic structure 16 is about between 50 and 200, and each of the second magnetic permeability $\mu 2$ of the first gap G1 and the third magnetic permeability $\mu 3$ of the second gap G2 is about 1. Because the first magnetic permeability $\mu 1$ of the magnetic structure 16 is larger than each of the second magnetic permeability $\mu 2$ of the first gap G1 and the third magnetic permeability $\mu 3$ of the second gap G2, the initial flux will passes through the magnetic structure 16 when a current passes through variable coupled inductor 1. It should be noted that the first magnetic permeability $\mu 1$ of the magnetic structure 16 is larger than each of the second magnetic permeability $\mu 2$ of the first gap G1 and the third magnetic permeability $\mu 3$ of the second gap G2 to achieve the effect of the variable inductance coupling regardless of the material of the first core 10 and the second core 14 (i.e. regardless of the magnetic permeability of the first core 10 and the second core 14).

Furthermore, the first core 10 has a fourth magnetic permeability $\mu 4$, and the second core 14 has a fifth magnetic permeability $\mu 5$. For example, in another embodiment, when the magnetic structure 16, the first core 10 and the second core 14 are all made of ferrite material, the first magnetic permeability $\mu 1$, the fourth magnetic permeability $\mu 4$ and the fifth magnetic permeability $\mu 5$ are the same. When the material of the magnetic structure 16 is ferrite material, the initial-inductance characteristic of the variable coupled inductor 1 can be enhanced and the efficiency of the variable coupled inductor 1 in a light-load situation can be improved as well. It should be noted that the relationship between the first magnetic permeability $\mu 1$, the second magnetic permeability $\mu 2$, the third magnetic permeability $\mu 3$, the fourth magnetic permeability $\mu 4$ and the fifth magnetic permeability $\mu 5$ is: $\mu 1 \geq \mu 4 > \mu 2 \geq \mu 3$ and $\mu 1 \geq \mu 5 > \mu 2 \geq \mu 3$, regardless of the material of the magnetic structure 16, the first core 10 and the second core 14.

In summary, the present invention proposes that the magnetic structure 16 having a high magnetic permeability (i.e. the first magnetic permeability $\mu 1$ described above) is disposed between the second projection 102 in the middle of the first core 10 and the second core 14, and the magnetic structure 16 is symmetric with respect to the central line CL of the second protrusion 102. Therefore, by using the magnetic structure 16, the initial-inductance of the variable coupled inductor 1 can be enhanced and efficiency can be improved in a light-load situation.

Figure 5:
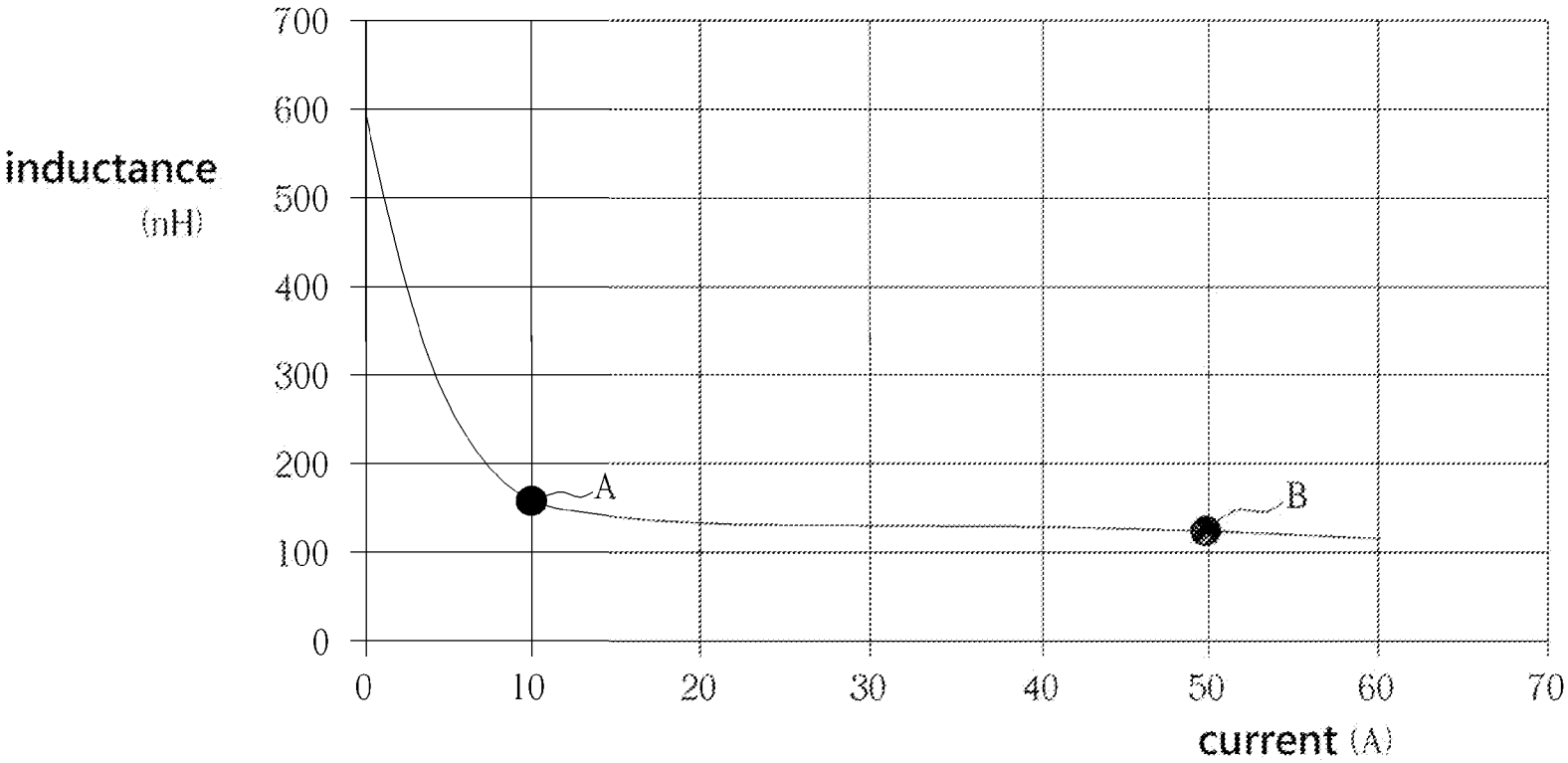
FIG. 5 illustrates the relationships between the measured inductances and the currents in the variable coupled inductor in FIG. 1.

Please refer to FIG. 5 and Table 1. FIG. 5 illustrates the relationship between the inductances and the currents measured in the variable coupled inductor 1 in FIG. 1, and table 1 lists the inductances and the currents in different measurements. As illustrated in FIG. 5, point A is a conversion point between light-load and heavy-lead situations (In this embodiment, the current at point A is, but not limited to, 10A.,) and the current at the point B is the maximum current to be expected to achieve (In this embodiment, the current at point B is, but not limited to, 50A.). Herein, Light-load is called when the current is below the point A. From FIG. 5 and Table 1, the inductance of the variable coupled inductor 1 in a light-load situation is apparently enhanced, so that the variable coupled inductor 1 of the present invention can effectively improve light-load efficiency. It should be noted that, in this embodiment, the total height H of the variable coupled inductor 1 is about 4.07 mm, the vertical distance D1 of the first gap G1 is between 0.03 mm and 0.2 mm, and the vertical distance D2 of the second gap G2 is between 0.08 mm and 0.7 mm.

TABLE 1

| current (A) | inductance (nH) |
|---|---|
| 0 | 599.6 |
| 5 | 269.8 |
| 10 | 159.35 |
| 11 | 154.38 |
| 12 | 150.52 |
| 13 | 147.55 |
| 14 | 145.29 |
| 15 | 143.61 |
| 20 | 138.05 |
| 25 | 134.3 |
| 30 | 131.45 |
| 35 | 129.3 |
| 40 | 127.4 |
| 45 | 125.5 |
| 50 | 123.6 |
| 55 | 121.7 |
| 60 | 119.8 |

In this embodiment, the magnetic structure 16 has a first surface area A1, and the second protrusion 102 has a second surface area A2. As illustrated in FIG. 3, the length of the magnetic structure 16 and the length of the second protrusion 102 are both X; the width of the magnetic structure 16 is Y1, and the width of the second protrusion 102 is Y2; the first surface area Al of the magnetic structure 16 is X*Y1; the second surface area A2 of the second protrusion 102 is X*Y2. If the current at point A is defined as a first current I1, and the current at point B is defined as a second current I2, the relationship between the first current I1, the second current I2, the first surface area A1 and the second surface area A2 can represented as 1.21 (I1/I2)≥A1/A2≥0.81 (I1/I2). Furthermore, a first inductance L1 can be measured at the first current I1, and a second inductance L2 can be measured at the second current 12; the relationship between the first inductance L1 and the second inductance L2 can represented as 0.8L1≥L2≥0.7L1. In other words, the present invention proposes that the first inductance L1 at the first current I1 (i.e. the current at the conversion point between light-load and heavy-lead described above) and the second inductance L2 at the second current 12 (i.e. the maximum current to be expected to achieve) can be adjusted by adjusting the first surface area A1 and the second surface A2.

It should be noted that the first current I1 can be defined as follows. A third inductance L3 is measured when the first current I1 plus 1 amp is applied and 5.5 nH≥L1-L3≥4.5 nH. For example, the first current I1 of this embodiment is 10A, and the corresponding first inductance L1 is 159.35 nH; the first current I1 plus 1 equals 11A, and the corresponding third inductance L3 is 154.38 nH, wherein L1-L3=4.97 nH is obtained and 5.5 nH≥4.97 nH≥4.5 nH is satisfied. As defined above, when the current passes through the variable coupled inductor 1 in accordance with present invention, the corresponding current (i.e. the first current I1 described above) at point A in FIG. 4 can be derived by measuring the inductance.

Figure 6:
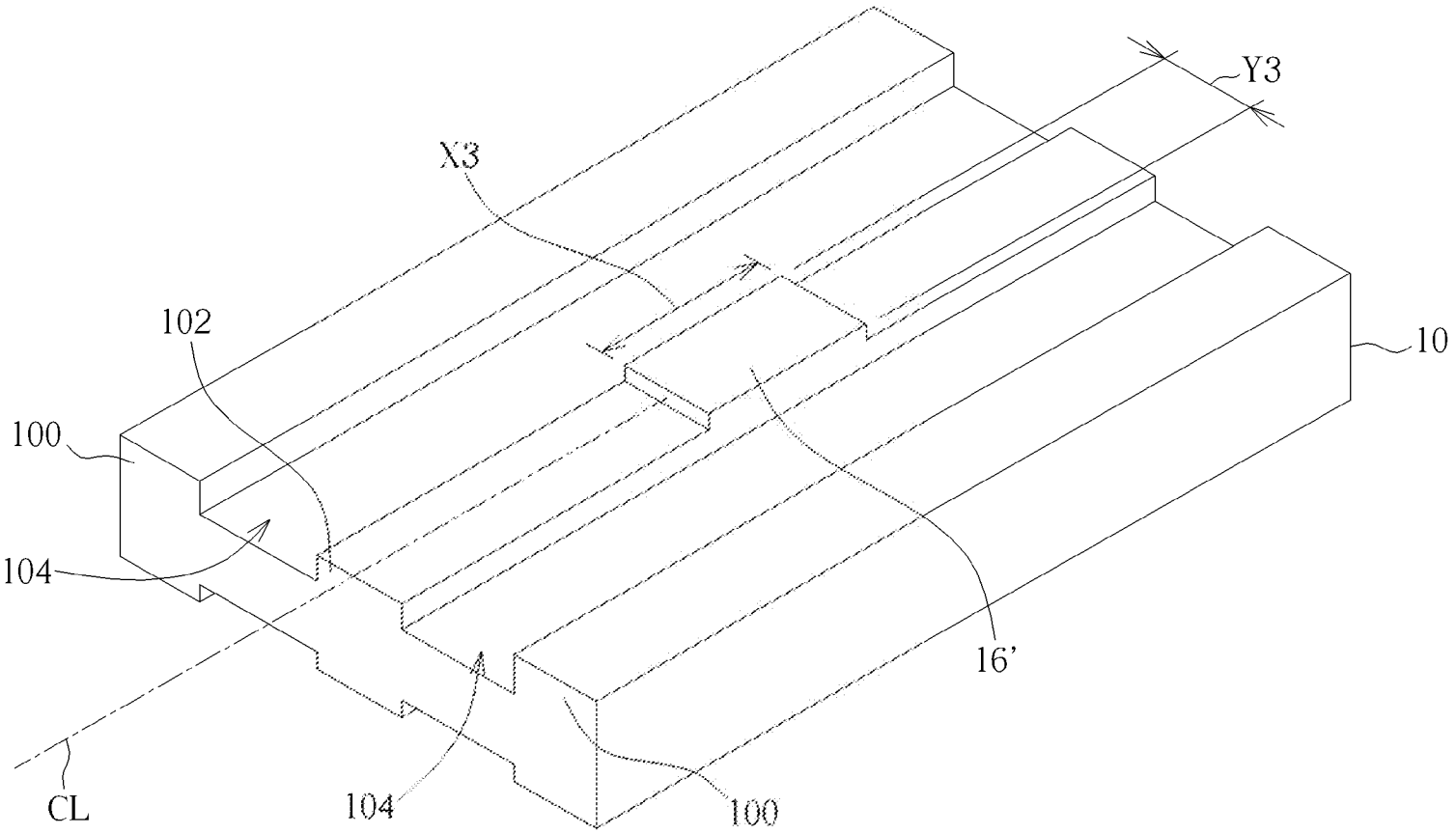
FIG. 6 illustrates a three dimensional view of the first core and the magnetic structure in accordance with one embodiment of present invention.

Please refer to FIG. 6. FIG. 6 is a three dimensional view of a first core 10 and a magnetic structure 16' according to another embodiment of the present invention. The main difference between the magnetic structure 16 described above and the magnetic structure 16' is that the length X3 of the magnetic structure 16' is smaller than the length X of the magnetic structure 16, and the width Y3 of the magnetic structure 16' is larger than the width Y1 of the magnetic structure 16. In this embodiment, the surface area X3*Y3 of the magnetic structure 16' is equal to the surface area X*Y1 of the magnetic structure 16. Furthermore, the magnetic structure 16' is still symmetric with respect to the central line CL of the second protrusion 102. It should be noted that the magnetic structure 16' and the first core 10 can be integrally formed or the magnetic structure 16' and the second core 14 can be integrally formed. Alternatively, the magnetic structure 16' can be an independent device.

Figure 7:
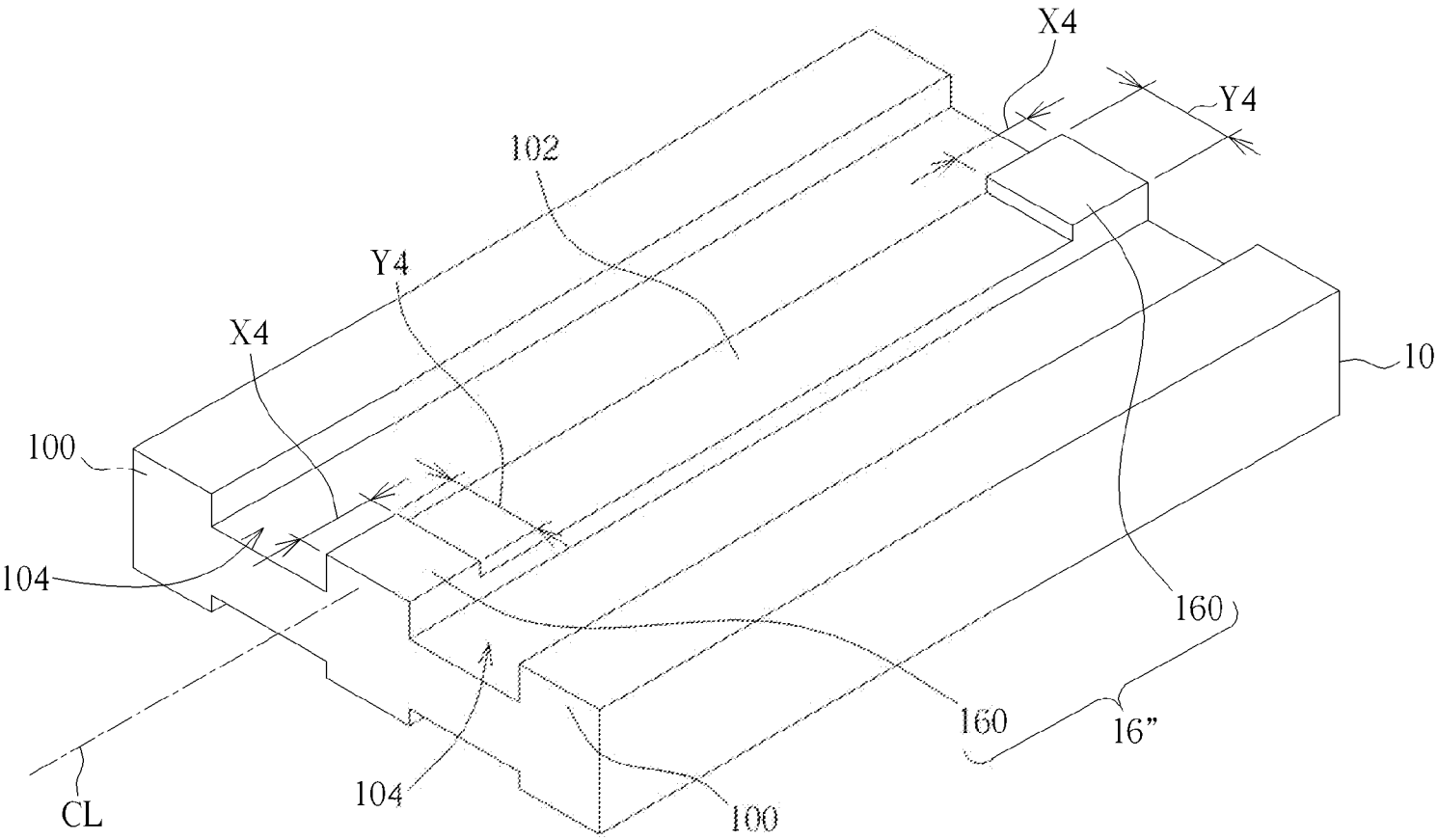
FIG. 7 illustrates a three dimensional view of the first core and the magnetic structure in accordance with another embodiment of present invention.

Please refer to FIG. 7. FIG. 7 is a three dimensional view of a first core 10 and a magnetic structure 16" according to another embodiment of the present invention. The main difference between the magnetic structure 16 described above and the magnetic structure 16" is that the magnetic structure 16" comprises two segments 160, and the length and the width of each segment 160 are respectively X4 and Y4. In this embodiment, the surface area (X4*Y4)*2 of the magnetic structure 16" is equal to the surface area X*Y1 of the magnetic structure 16. Furthermore, the magnetic structure 16" is still symmetric with respect to the central line CL of the second protrusion 102. It should be noted that the magnetic structure 16" and the first core 10 can be integrally formed or the magnetic structure 16" and the second core 14 can be integrally formed. Alternatively, the magnetic structure 16" can be an independent device.

Figure 8:
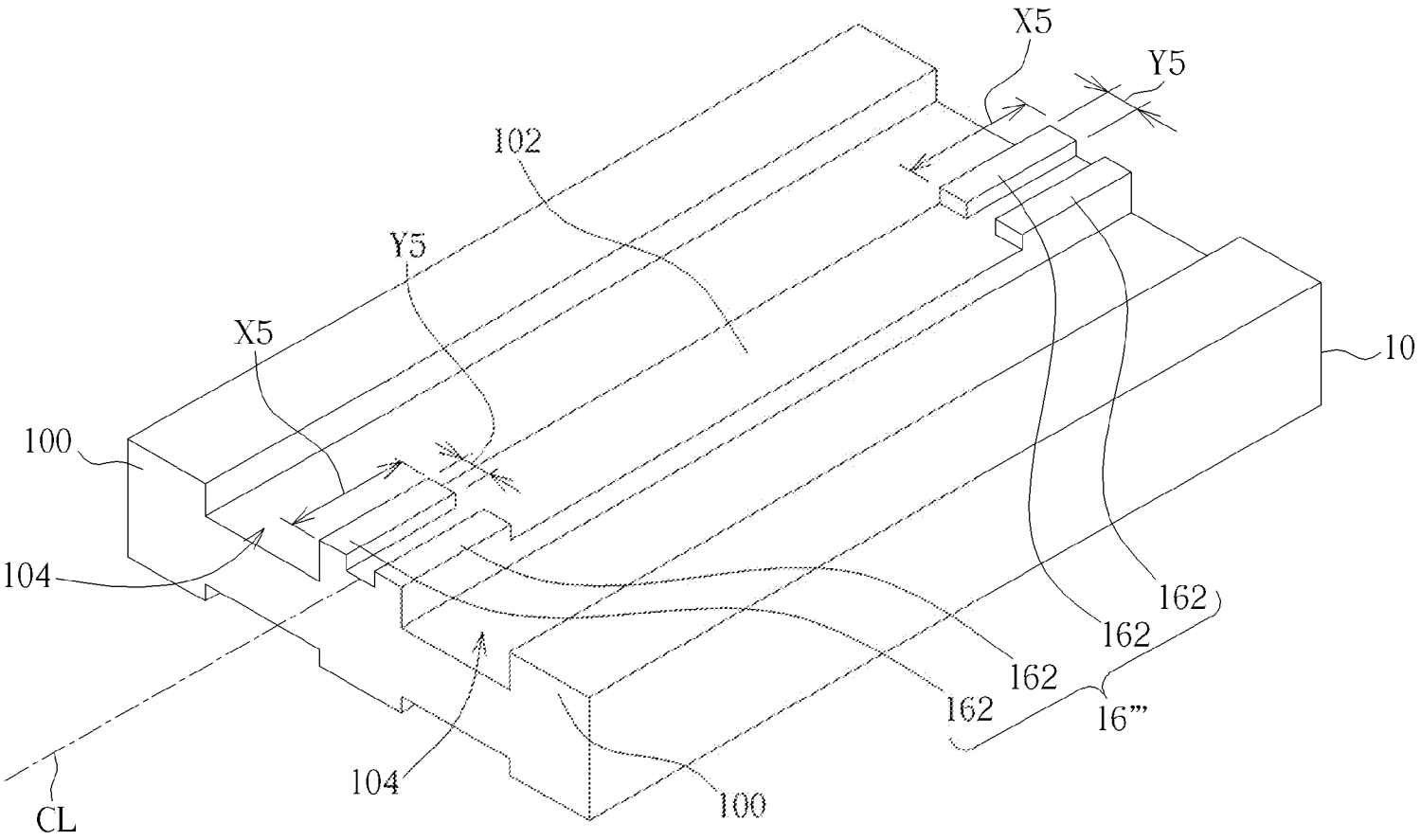
FIG. 8 illustrates a three dimensional view of the first core and the magnetic structure in accordance with yet another embodiment of present invention.

Please refer to FIG. 8. FIG. 8 is a three dimensional view of a first core 10 and a magnetic structure 16''' according to another embodiment of the present invention. The main difference between the magnetic structure 16 described above and the magnetic structure 16''' is that the magnetic structure 16''' comprises four segments 162, and the length and the width of each segment are X5 and Y5 respectively. In this embodiment, the surface area (X5*Y5)*4 of the magnetic structure 16''' is equal to the surface area X*Y1 of the magnetic structure 16. Furthermore, the magnetic structure 16''' is still symmetric with respect to the central line CL of the second protrusion 102. It should be noted that the magnetic structure 16''' and the first core 10 can be integrally formed or the magnetic structure 16''' and the second core 14 can be integrally formed. Alternatively, the magnetic structure 16''' can be an independent device.

In other words, the number of the segments and appearance of the magnetic structure can be designed in many ways as long as the same surface area is maintained. The magnetic structure is symmetric with respect to the central line CL of the second protrusion 102 regardless of the number of the segments and appearance of the magnetic structure In conclusion, the present invention proposes that the magnetic structure is disposed between the second projection 102 in the middle of the first core 10 and the second core, and the magnetic structure is symmetric with respect to the central line CL of the second protrusion 102. Therefore, the initial-inductance of the variable coupled inductor can be enhanced and light-load efficiency can be improved by means of the magnetic structure. Furthermore, the material of the variable coupled inductor of the present invention can be a ferrite material to achieve a high-saturation current, and copper sheet is used as an electrode to reduce the DC resistance, so efficiency is better in heavy-load. In other words, the variable coupled inductor of the present invention can improve efficiency in both light-load and heavy-load situations.

The above disclosure is related to the detailed technical contents and inventive features thereof. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. A variable coupled inductor, comprising:

a first core having a top surface and a bottom surface, a first lateral surface and a second lateral surface opposite to the first lateral surface, wherein the first core comprises a first protrusion, a second protrusion, a third protrusion, a first conducting-wire groove and a second conducting-wire groove, each of which extending from the first lateral surface to the second lateral surface on the top surface, wherein the second protrusion is disposed between the first protrusion and the third protrusion, the first conducting-wire groove is located between the first protrusion and the second protrusion, and the second conducting-wire groove is located between the second protrusion and the third protrusion;

a first conducting wire disposed in the first conducting-wire groove and a second conducting wire disposed in the second conducting-wire groove, wherein the first conducting wire and the second conducting wire are extended to wrap around the first core at two opposite sides of the second protrusion of the first core via the bottom surface;

a second core disposed over the first core; and a magnetic structure disposed between the second protrusion and the second core, wherein the magnetic structure comprises a first portion and a second portion, wherein the first portion and the second portion are symmetric to each other with respect to the central line of the second protrusion, wherein the central line extends from a first middle point of a first edge of the second protrusion on the first lateral surface to a second middle point of a second edge of the second protrusion on the second lateral surface, wherein the magnetic structure has a first surface area A1, and the second protrusion has a second surface area A2, wherein a first inductance L1 of the variable coupled inductor corresponds to a current I1 applied to the variable coupled inductor at a conversion point between light load and heavy load situations, and a second inductance L2 of the variable coupled inductor corresponds to a maximum current I2 applied to the variable coupled inductor, wherein $1.21(I1/I2) \geq A1/A2 \geq 0.81(I1/I2)$ and $0.8L1 \geq L2 \geq 0.7L1$.

2. The variable coupled inductor according to claim 1, wherein a first gap is formed between the first protrusion and the second core, a second gap is formed between the second protrusion and the second core and a third gap is formed between the third protrusion and the second core, wherein the vertical distance of each of the first gap and the third gap is smaller that of the second gap.

3. The variable coupled inductor according to claim 2, wherein the variable coupled inductor has a high H, the vertical distance of each of the first gap and the third gap is between 0.0073 H and 0.0492 H, and the vertical distance of the second gap is between 0.0196 H and 0.1720 H.

4. The variable coupled inductor according to claim 2, wherein the magnetic structure has a first magnetic permeability $\mu 1$, each of the first gap and the third gap has a second magnetic permeability $\mu 2$, and the second gap has a third magnetic permeability $\mu 3$, wherein the relationship between the first magnetic permeability $\mu 1$, the second magnetic permeability $\mu 2$ and the third magnetic permeability $\mu 3$ is: $\mu 1 > \mu 2 \geq \mu 3$.

5. The variable coupled inductor according to claim 1, wherein the first core has a fourth magnetic permeability $\mu 4$, and the second core has a fifth magnetic permeability $\mu 5$, wherein the relationship between the first magnetic permeability $\mu 1$, the second magnetic permeability $\mu 2$, the third magnetic permeability $\mu 3$, the fourth magnetic permeability $\mu 4$ and the fifth magnetic permeability $\mu 5$ is: $\mu 1 \geq \mu 4 > \mu 2 \geq \mu 3$ and $\mu 1 \geq \mu 5 > \mu 2 \geq \mu 3$.

6. The variable coupled inductor according to claim 2, wherein each of the first gap, the second gap and the third gap lies in a height covered by the vertical distance between the bottom surface of the first conducting-wire groove and the second core.

7. The variable coupled inductor according to claim 1, wherein the magnetic structure and the first core are integrally formed.

8. The variable coupled inductor according to claim 1, wherein the magnetic structure and the second core are integrally formed.

9. The variable coupled inductor according to claim 1, wherein the magnetic structure comprises a segment, wherein the length of the segment is the same as the length of the second protrusion, and wherein a first portion of the segment is symmetric to a second portion of the segment with respect to the central line of the second protrusion.

10. The variable coupled inductor according to claim 1, wherein the magnetic structure is in full contact with the first core and the second core.

11. The variable coupled inductor according to claim 1, wherein a third inductance L3 of the variable coupled inductor is measured at the first current Il plus one amp applied to the variable coupled inductor, wherein $5.5nH \geq L1 - L3 \geq 4.5nH$.

12. The variable coupled inductor according to claim 2, wherein each of the first gap and the third gap is a non-magnetic gap, and the second gap is an air gap or a non-magnetic gap.

13. The variable coupled inductor according to claim 1, wherein the magnetic structure comprises a segment, wherein the length of the segment is less than the length of the second protrusion, and wherein a first portion of the segment is symmetric to a second portion of the segment with respect to the central line of the second protrusion.

14. The variable coupled inductor according to claim 1, wherein the magnetic structure comprises a first segment and a second segment, wherein each of the first segment and the second segment comprises one potion that is symmetric to the other portion of said segment with respect to the central line of the second protrusion.

15. The variable coupled inductor according to claim 1, wherein the magnetic structure comprises a first segment, a second segment, a third segment and a fourth segment, wherein the first segment and the second segment are symmetric to each other with respect to the central line of the second protrusion, and the third segment and the fourth segment are symmetric to each other with respect to the central line of the second protrusion.

16. The variable coupled inductor according to claim 1, wherein the first core further comprises a fourth protrusion, a fifth protrusion, a sixth protrusion, a third conducting-wire groove and a fourth conducting-wire groove on the bottom surface of the core, wherein the third conducting-wire groove is located between the fourth protrusion and the fifth protrusion, and the fourth conducting-wire groove is located between the fifth protrusion and the sixth protrusion, wherein the first conducting wire and the second conducting wire wrap around the first core via the third conducting-wire groove and the fourth conducting-wire groove on the bottom surface of the first core, respectively.

17. A variable coupled inductor, comprising:

a first core having a top surface and a bottom surface, a first lateral surface and a second lateral surface opposite to the first lateral surface, wherein the first core comprises a first protrusion, a second protrusion, a third protrusion, a first conducting-wire groove and a second conducting-wire groove, each of which extending from the first lateral surface to the second lateral surface on the top surface, wherein the second protrusion is disposed between the first protrusion and the third protrusion, the first conducting-wire groove is located between the first protrusion and the second protrusion, and the second conducting-wire groove is located between the second protrusion and the third protrusion;

a first conducting wire disposed in the first conducting-wire groove and a second conducting wire disposed in the second conducting-wire groove, wherein the first conducting wire and the second conducting wire are extended to wrap around the first core at two opposite sides of the second protrusion of the first core via the bottom surface;

a second core disposed over the first core; and a magnetic structure disposed between the second protrusion and the second core, wherein the magnetic structure comprises a first portion and a second portion, wherein the first portion and the second portion are symmetric to each other with respect to the central line of the second protrusion, wherein the central line extends from a first middle point of a first edge of the second protrusion on the first lateral surface to a second middle point of a second edge of the second protrusion on the second lateral surface, wherein the magnetic structure has a first surface area A1, and the second protrusion has a second surface area A2, wherein a first inductance L1 of the variable coupled inductor is measured at a first current Il applied to the variable coupled inductor, and a second inductance L2 of the variable coupled inductor is measured at a second current I2 applied to the variable coupled inductor, wherein I2I11.21(I1/I2)≥A1/A2≥0.81(I1/I2) and 0.8L1≥L2≥0.7L1, wherein a third inductance L3 of the variable coupled inductor is measured at the first current I1 plus one amp applied to the variable coupled inductor, wherein 5.5nH≥L1−L3≥4.5nH.

* * * * *